US005695050A

United States Patent [19]

Weaver

[11] Patent Number: 5,695,050

[45] Date of Patent: Dec. 9, 1997

[54] CONTAINER CARRIER WITH DIFFERENT COEFFICIENTS OF FRICTION

[75] Inventor: William N. Weaver, Northbrook, Ill.

[73] Assignee: Illinois Tool Works Inc., Glenview, Ill.

[21] Appl. No.: 660,815

[22] Filed: Jun. 10, 1996

[51] Int. Cl.[6] ..... B65D 75/00

[52] U.S. Cl. ..... 206/150; 206/151; 206/153

[58] Field of Search ..... 206/150, 153, 206/151, 163; 294/87.2

[56] References Cited

U.S. PATENT DOCUMENTS

| | | | |
|---|---|---|---|
| 4,401,211 | 8/1983 | Pillman et al. | 206/150 |
| 4,724,655 | 2/1988 | Lew | 206/150 |
| 4,941,573 | 7/1990 | Fuerstman | 206/459 |
| 5,016,750 | 5/1991 | Gordon | 206/150 |
| 5,544,749 | 8/1996 | Watts | 206/150 |

*Primary Examiner*—David T. Fidei

*Attorney, Agent, or Firm*—Speckman, Pauley & Fejer

[57] ABSTRACT

A multi-package carrier device having a strip of a relatively high coefficient of friction material along an inner portion of the carrier. A high coefficient of friction, "tactile," material is applied to an encircling aperture style multi-package carrier device made from a relatively low coefficient of friction thermoplastic base material sheet. A strip of the tactile material is applied along one side of the base material of the multi-package carrier. The base material containing the tactile material is then cut into multi-package carriers such that the tactile material traverses a center portion of a container contacting surface of the multi-package carrier. The multi-package carrier is applied to a plurality of containers. After the multi-package carrier is applied to the containers, the tactile material between the rows of containers is in close contact with an upper portion of the container sidewall. The high coefficient of friction tactile material resists movement of the containers with respect to the carrier.

5 Claims, 1 Drawing Sheet

CONTAINER CARRIER WITH DIFFERENT COEFFICIENTS OF FRICTION

BACKGROUND OF THE INVENTION

1. Field of the Invention

This invention relates to a carrier device, for unitizing a plurality of containers, of a relatively low coefficient friction base material having a high coefficient of friction portion.

2. Description of Prior Art

Carrier devices for holding and transporting multiple containers, "multi-package carriers," are typically extruded thermoplastic sheets with apertures formed by a plurality of integrally connected bands, created by stamping or cutting the sheet with dies. These bands are stretched to allow application to a container. Generally these containers are cans, bottles, jars and boxes, although other packages or containers may be unitized.

Carrier devices of the type described are typically manufactured by extruding sheet thermoplastic material, for example low density polyethylene, in thicknesses generally in the range of 0.010–0.030 inches. In typical plastic extruding operations, as the sheet is extruded, it is fed through a series of sizing and/or cooling rolls which are of a smooth finish consistent with conventional plastics manufacture. The extruded and stamped material is stretched and applied to the containers, resulting in a close fitting surface-to-surface contact between the container contacting surfaces of the carrier device and the container surface.

Package integrity during pre-consumer handling is partially dependent upon the ability of the containers to remain in a carrier device relatively fixed with respect to one another, either rotationally, horizontally, or vertically within that device. Additionally, a lower gage carrier device generally results in reduced package integrity. Multi-packages, especially in the beverage industry, are transported in large quantities and often stacked on pallets of cases of four or more multi-packages up to forty-eight cases high. Thus, as package integrity is reduced, and can shifting increases, warehouse storage and transportation storage become less efficient and more problematic.

The prior art teaches multi-package carriers that allow rotation of the cans within the carriers in order to permit certain portions of graphics on the containers to positioned for uniformity or readability. U.S. Pat. No. 4,401,211 describes a multi-package carrier that permits free rotation of cans with respect to the carrier device because of a carrier material having a lower coefficient of friction between the container and device relative to multi-package carriers known in the prior art.

In the past, carrier devices of the type described have been applied to the can at, or near, the top of the can. These conventional carrier devices are typically referred to as rim-applied carriers. The rim-applied carrier facilitates consumer handling with integral finger loops located between the cans within the applied carrier. The rim-applied carrier effectively retains the cans because of an interface between a chime or lid of the can and the carrier edge, in addition to frictional mating between the carrier surface and the sidewall surface of the can. Certain can configurations may have a reduced diameter lid or chime compared to the diameter of the body of the can with the lid and body being joined by a tapered or "necked-in" portion. The rim-applied carrier for necked-in cans have some disadvantages. For example, rim-applied carriers for such cam, require a relatively stiff and/or specific material to maintain package integrity due to the tapered surface.

One solution to the above disadvantages is to use a carrier applied approximately at the mid-section of the container sidewall, referred to as a sidewall applied carrier. This carrier configuration permits the use of a slightly lower gage material relative to a rim-applied carrier. Additionally, the cam are held in a more stable "block" resulting in better package integrity than the rim-applied carrier package, particularly in the pallet stacking situation noted above. The sidewall applied carrier does slide a small amount up or down with respect to the cans, but this is permissible because the applied carrier is located near the mid-section of the sidewall. However, the carrier may not be applied close to the top or bottom of the can sidewall because the cans may slide out of the carrier. Also the ability to handle the package from the top without an increase in material is reduced by such a sidewall applied carrier.

Therefore, there is a need for a multi-package carrier device that can be carried from the top and that possesses the stability and material benefits of both a rim-applied carrier and a sidewall applied carrier.

SUMMARY OF THE INVENTION

It is one object of this invention to provide a multi-package carrier device that maintains a position near the top of the sidewall of the container.

It is another object of this invention to provide a multi-package carrier device that limits relative motion of the containers.

It is another object of this invention to provide a multi-package carrier device that accommodates top lifting of the carrier by the consumer without the addition of excess material.

It is yet another object of this invention to provide a multi-package carrier device that may be constructed from a relatively thin gage material that is also recyclable or capable of reprocessing.

It is still another object of this invention to provide a multi-package carrier device that may be applied at any location along a container sidewall and accommodate shaped or stylized containers.

These and other objects of this invention are achieved, according to one preferred embodiment of this invention, with a multi-package carrier device of a relatively low coefficient of friction base material having a tactile strip of a relatively high coefficient of friction material along a center portion of the carrier.

A high coefficient of friction, "tactile," material is applied to a ring/encircling aperture style multi-package carrier device made from a relatively low coefficient of friction thermoplastic base material sheet. According to a preferred embodiment of this invention, a strip of the tactile material is coated along one side, the container contacting surface, of the base material of the multi-package carrier. The base material containing the tactile material is then die cut into multi-package carriers such that the tactile material traverses the center portion of the multi-package carrier.

The multi-package carrier is applied, in one preferred embodiment of this invention, to groups of cans, thus constituting a completed multi-package, i.e., "six-pack." After the multi-package carrier is applied to the cans, the tactile material between the rows of cans contacts the can sidewall. The high coefficient of friction tactile material contained on the base material resists sliding along the can sidewall surface thus resisting movement of the cans with respect to the carrier.

As used throughout this specification and in the claims, the words can, container, bottle, and/or any other suitable container known to those skilled in the art, are intended to be interchangeable.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
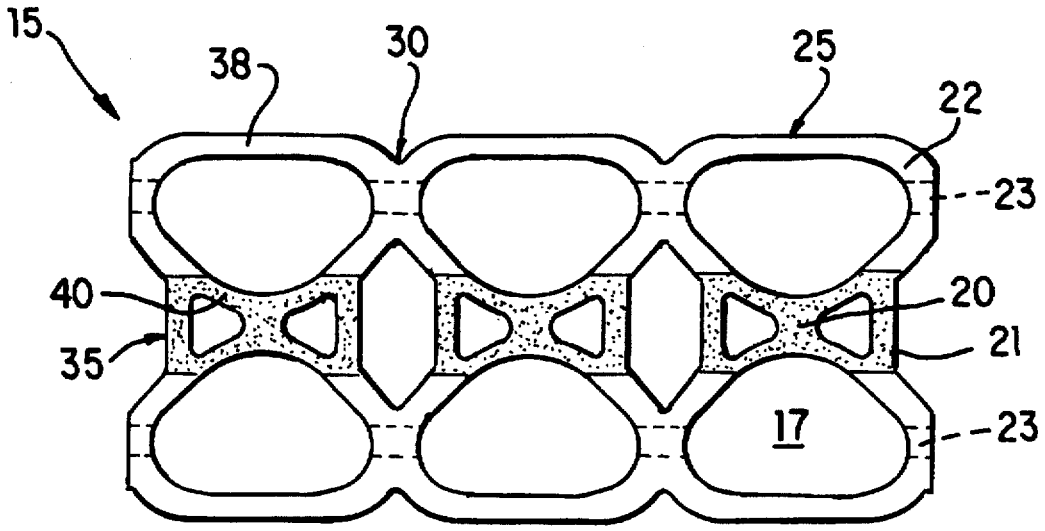
FIG. 1 shows a top view of a multi-package carrier according to one preferred embodiment of this invention.

FIG. 1 is a top view of one preferred embodiment of multi-package carrier 15 according to this invention. In a manner similar to the types of multi-package carriers described above, multi-package carrier 15 according to one preferred embodiment of this invention comprises thermoplastic base material 22 preferably of an extruded polyethylene sheet material. The polyethylene preferably contains an internal slip additive that starts exuding to the surface of the material immediately after extrusion. Preferably, the slip additive creates a slippery, low coefficient of friction base material surface that allows for easy processing of the polyethylene sheet through the cutting dies and high speed applicating machinery that applies multi-package carriers 15 to containers 12.

Figure 2:
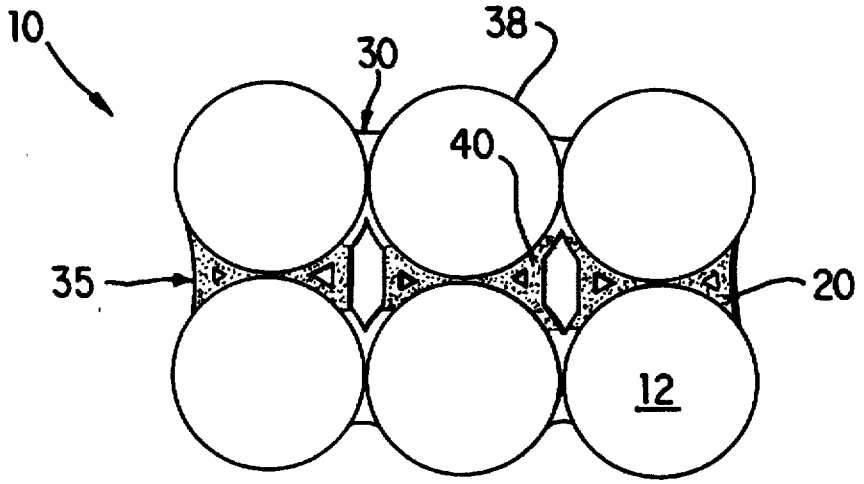
FIG. 2 shows a diagrammatic top view of a multi-package as applied to containers, according to one preferred embodiment of this invention.

Tactile material 20 having a high coefficient of friction relative to base material 22 is adhered to base material 22, preferably in a relatively narrow centrally located strip 21 such as shown in FIG. 1. Since FIG. 1 is a top view, tactile material 20 is on the bottom surface of carrier 15. For illustrative purposes, tactile material 20 is indicated in FIGS. 1 and 2 with a shaded area. According to a preferred embodiment of this invention, multi-package carrier 15 is constructed from semi-translucent material although it is apparent that opaque or otherwise tinted materials may be utilized.

A plurality of narrow strips could also be included in the invention, for example, 2 additional strips 23 could be added to the lower surface of carrier 15 in the areas of the dotted lines of FIG. 1. The additional strips would increase the integrity of the packages by tending to prevent relative movement of adjacent cans in their axial directions.

According to one preferred embodiment of this invention, multipackage carrier 15 comprises base material 22 and tactile material 20 having two different coefficients of friction.

Tactile material 20 is applied to the lower surface of multi-package carrier 15 that will, upon application to containers 12, contact sidewall 13. According to one preferred embodiment of this invention tactile material 20 comprises a strip of approximately 0.868–0.875 density Dow Engage™ polyethylene material approximately 1 inch wide and approximately 0.0005 inches thick. Tactile material 20 is applied to a single side of base material 22. Tactile material 20 may be extrusion coated on base material 22 or co-extruded with base material 22. Polymer emulsions or hot melt adhesives may also be used in place of, or in combination with, a polyethylene material. Tactile material 20 may be sprayed, taped, roller coated or otherwise applied to polyethylene base material 22 using processing techniques known to those skilled in the art. It is desirable to use tactile material 20 that is compatible with base material 22 for reprocessing and recycling purposes. Tactile material 20 is preferably applied to base material 22 prior to stamping individual multi-package carriers 15.

After tactile material 20 is applied to base material 22, the resulting material sheet is preferably stamped or die-cut to create individual multi-package carriers 15.

Each multi-package carrier 15 preferably comprises a plurality of bands 25, as best shown in FIG. 1, forming container receiving apertures 17. In a preferred embodiment of this invention, bands 25 are formed integrally with base material 22 through the die-cutting process. Preferably, bands 25 are connected longitudinally with first interconnecting webs 30 creating rows and are connected laterally with second interconnecting webs 35 creating ranks. Thus, in one preferred embodiment of this invention, two rows of three ranks of container receiving apertures 17 are shown which, upon application to containers 12, form a "six-pack" multi-package 10 shown in FIGS. 2 and 3. It should be understood for the purposes of this invention that the package and carrier devices described in this invention are not limited to the two rows of three ranks arrays but could be any variety of arrays of bands and apertures desired to create an acceptable and feasible package.

With multi-package carrier 15 applied to containers, bands 25 form container receiving apertures 17. Bands 25 are stretched to allow application to containers 12 using an applicating machine having multi-package carrier applicating jaws, as known to those skilled in the art. Multi-package carrier 15 is applied to containers 12 such that tactile material 20 is in surface area contact with sidewall 13 of container 12. As shown in FIG. 2, bands 25 form a generally circular opening. However, it is apparent that because bands 25 contact a peripheral surface of sidewall 13, bands 25 will conform to the peripheral shape of container 12 and form any other suitable shape of aperture 17. During application, stretching forces to apply multi-package carrier 15 are concentrated at outer region 38 of multi-package carrier 15. Outer region 38 of multi-package carrier 15 is defined along bands 25 connected by first interconnecting webs 30.

As shown in FIG. 2, tactile material 20 is positioned on base material 22 along second interconnecting webs 35, at inner region 40 of multi-package carrier 15, where bands 25 are connected laterally. The container retention forces of multi-package carrier 15 are primarily concentrated near inner region 40 of multi-package carrier 15. Inner region 40 is defined by second interconnecting webs 35 between bands 25. In one preferred embodiment of this invention, a handle or finger loops are also located in inner region 40. Therefore, lifting forces are applied at or near inner region 40 of multi-package carrier 15. The lower surfaces of the finger loops will also include the tactile coating material 20, thus increasing the handling capability of the package. Tactile material 20 is positioned on base material 22 on a container contacting surface of multi-package carrier 15. In the preferred embodiment, the container contacting surface is the uppermost extremity of the body portion 13, and immediately below the tapered portion 14, which interconnects the reduced diameter lid 19 to the body portion 13. Upon application, multi-package carrier 15 having tactile material 20 is in close surface-to-surface contact with the relatively smooth, low coefficient of friction sidewall 13 of container 12. In one preferred embodiment of this invention, tactile material 20 is positioned on base material 22 at inner region 40 of multi-package carrier 15 container contacting surfaces. Therefore, the location of tactile material 20 along the length of inner region 40 of multi-package carrier 15 concentrates the highest coefficient of friction in an area of the multi-package carrier 15 that requires high container retention forces.

Tactile material 20, as shown in FIGS. 1 and 2, in one preferred embodiment of this invention is a continuous strip 21 along inner region 40 of multi-package carrier 15. However, tactile material 20, in another preferred embodiment of this invention, may be positioned along base material 22 in several narrow strips, in intermittent strips, or in any other alignment known to those with skill in the art.

The position of tactile material 20 on base material 22 along inner region 40 of multi-package carrier 15 enables effective application of multi-package carrier 15 to containers 12. Additionally, if tactile material 20 is positioned on base material 22 at outer region 38 of multi-package carrier 15, multi-package carrier 15 may be more difficult to strip from the jaws of the applicating machine than a multi-package carrier without tactile material 20. This increased difficulty arises because the jaws of the applicating machine grip multi-package carrier 15 primarily along bands 25 connected by first interconnecting webs 30 at outer region 38 of multi-package carrier 15. Therefore, tactile material 20, if applied along outer region 38 of multi-package carrier 15, would tend to resist multi-package carrier 15 from sliding off the applicating machine jaws during application.

The density, and thus, in one preferred embodiment of this invention, the coefficient of friction, of tactile material 20 may be adjusted to provide a balance between holding containers 12 in a fixed position and allowing limited rotation of containers 12 relative to bands 25 defining container receiving apertures 17. Limited rotation of containers 12 relative to bands 25 defining container receiving apertures 17 may be desirable for merchandising purposes to facilitate display of container graphics or contents.

Figure 3:
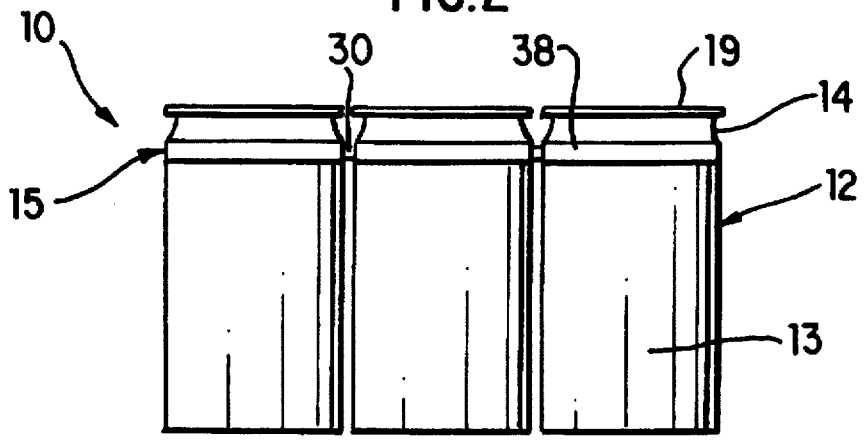
FIG. 3 shows a diagrammatic side view of a multi-package as applied to containers, according to one preferred embodiment of this invention.

As shown in FIG. 3, multi-package carrier 15 according to one preferred embodiment of this invention is applied near the top of the body section 13 of containers 12. In experimental applications of multi-package carrier 15 on to cans, multi-package carrier 15 was applied to can sidewalls between ¾ inch and 1 inch below the chime 19. This created a very stable multi-package 10 and accommodated top lifting of multi-package 10 without multi-package carrier 15 sliding off of containers 12. The sidewall application described herein of multi-package carrier 15 permits the use of lower gage material because the stability of multi-package 10 is enhanced by tactile material 20. Top lifting of multi-package 10 from a position near the tops of containers 12 also reduces material necessary for an integral or welded carrying handle or finger loops.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A multi-packaging device for unitizing an array of containers, the device comprising:

a plurality of interconnected bands of a resilient deformable plastic sheet material, the bands forming a plurality of container receiving apertures arranged in adjacent rows and ranks, a first portion of a container contact surface of at least one of the bands having a first coefficient of friction, a second portion of the container contact surface having a second coefficient of friction, the first coefficient of friction being greater than the second coefficient of friction, and the first portion of the container contact surface positioned between the rows within the array of containers.

2. The multi-packaging device of claim 1 wherein the first portion of the container contact surface forms a strip along a length of the resilient deformable plastic sheet material.

3. The multi-packaging device of claim 1 wherein the first portion of the container contact surface is adhered to the resilient deformable plastic sheet material.

4. The multi-packaging device of claim 1 wherein the first portion of the container contact surface contacts at least one of the containers when the containers are engaged within the container receiving apertures.

5. The multi-packaging device of claim 1 wherein the first portion of the container contact surface is also positioned between ranks of at least one of the rows within the array of containers.

* * * * *